US005458464A

United States Patent [19]

Lee

[11] Patent Number: 5,458,464

[45] Date of Patent: Oct. 17, 1995

[54] BLADE MOUNTING DEVICE FOR A CEILING FAN

[76] Inventor: Ching T. Lee, No. 7, Lane 974, Feng Shih Rd., Feng Yuan City, Taichung Hsien, Taiwan

[21] Appl. No.: 335,988

[22] Filed: Nov. 8, 1994

[51] Int. Cl.[6] ..... F04D 29/34

[52] U.S. Cl. ..... 416/210 R; 416/5; D23/411

[58] Field of Search ..... 416/210 R, 214 R; D23/377, 379, 385, 411

[56] References Cited

U.S. PATENT DOCUMENTS

| | | | |
|---|---|---|---|
| D. 263,498 | 3/1982 | Markowitz | D23/411 |
| D. 285,720 | 9/1986 | Markwardt | D23/377 |
| D. 345,206 | 3/1994 | DiPasquale | D23/411 |
| D. 354,804 | 1/1995 | Tsuji | D23/385 |
| D. 355,028 | 1/1995 | Tsuji | D23/385 |
| 4,396,352 | 8/1983 | Pearce | D23/377 |
| 4,511,310 | 4/1985 | Pearce | 416/5 |
| 4,621,977 | 11/1986 | Markwardt | 416/5 |
| 4,850,799 | 7/1989 | Bucker, Sr. et al. | 416/5 |
| 5,304,037 | 4/1994 | Scofield | 416/210 R |
| 5,330,323 | 7/1994 | Swanson | 416/210 R |

*Primary Examiner*—Edward K. Look
*Assistant Examiner*—Mark Sgantzos
*Attorney, Agent, or Firm*—Kirkpatrick & Lockhart

[57] ABSTRACT

A blade mounting device for a ceiling fan includes a plurality of brackets each having a first distal end portion fixedly attached to a rotary portion of the ceiling fan and a second distal end portion onto which a corresponding one of blades is threadedly fitted, a plurality of recesses being defined in an underside of the second distal end portion of each of the brackets, a plurality of decorative members each fittingly mounted in and flush with a corresponding one of the recesses, each of the decorative members having a different configuration and decorative profile with each other.

4 Claims, 5 Drawing Sheets

BLADE MOUNTING DEVICE FOR A CEILING FAN

BACKGROUND OF THE INVENTION

1. Field of Invention

The present invention relates to a blade mounting device, and more particularly to a blade mounting device for a ceiling fan.

2. Related Prior Art

Conventional blade mounting devices for a ceiling fan are shown in FIGS. 6 and 7. However, by such an arrangement, there are still some shortcomings in the conventional blade mounting devices.

There will be a more complete and sufficient illustration in the detailed description of the preferred embodiments, concerning the conventional blade mounting devices.

The present invention has arisen to mitigate and/or obviate the above-mentioned disadvantages of the conventional blade mounting device.

SUMMARY OF THE INVENTION

The primary objective of the present invention is to provide a blade mounting device for a ceiling fan.

In accordance with one aspect of the present invention, there is provided a blade mounting device for a ceiling fan which comprises a rotary portion and a plurality of blades, the blade mounting device comprising a plurality of brackets each having a first distal end portion fixedly attached to the rotary portion of the ceiling fan and a second distal end portion onto which a corresponding one of the blades is threadedly fitted, a plurality of recesses being defined in an underside of the second distal end portion of each of the brackets, a plurality of decorative members each fittingly mounted in and flush with a corresponding one of the recesses, each of the decorative members having a different configuration and decorative profile with each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 6:
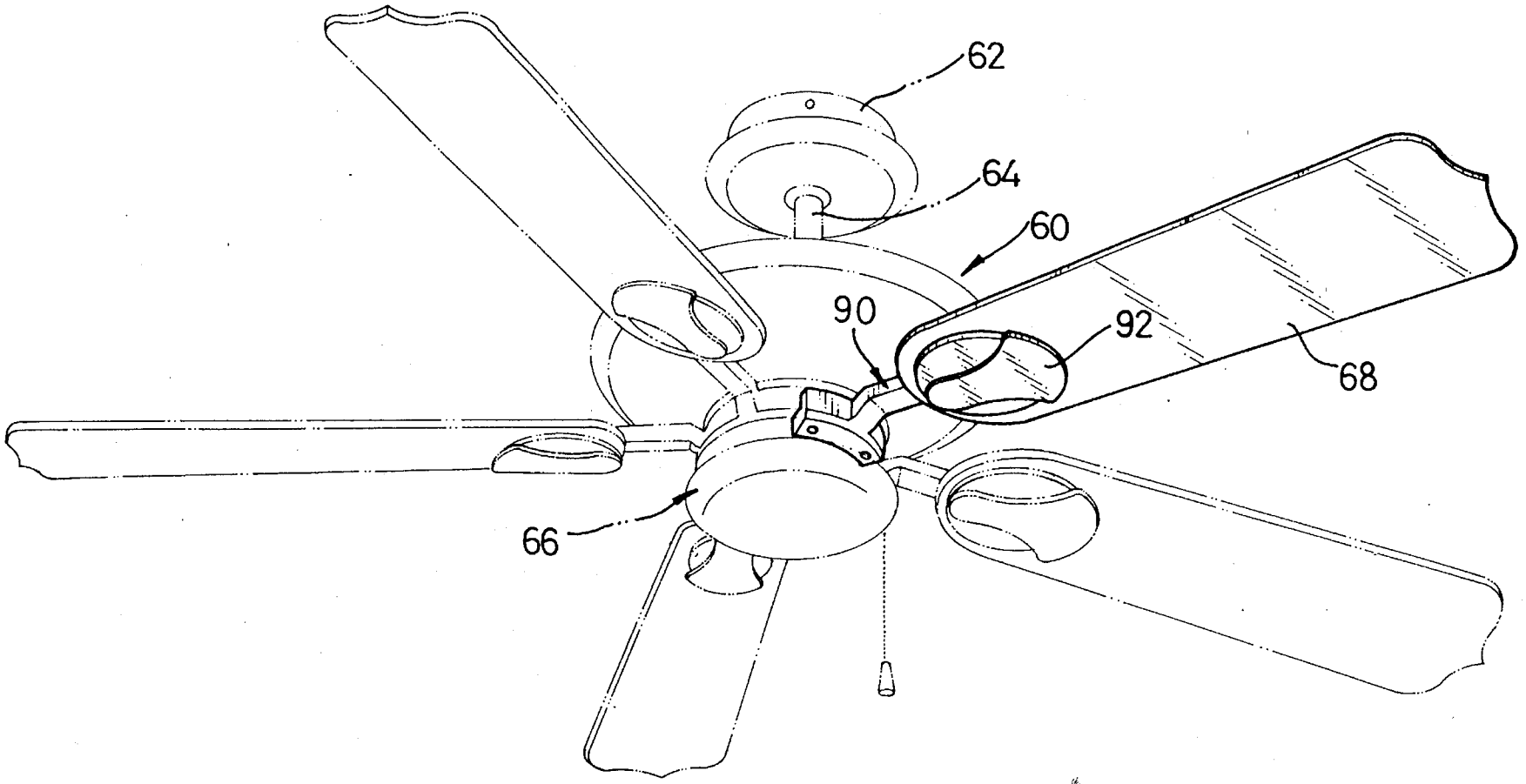
FIG.6 PRIOR ART
FIG. 6 is a perspective view of a first conventional blade mounting device for a ceiling fan in accordance with the prior art.

Referring to FIG. 6, a first conventional blade mounting device in accordance with the prior art is provided for a ceiling fan 60 which comprises a base portion 62 securely mounted on a ceiling (not shown), a shaft 64 fixedly mounted on and extending downwardly from an underside of the base portion 62, a rotary portion 66 rotatably mounted around the shaft 64, and a plurality of blades 68, the blade mounting device comprising a plurality of brackets 90 each having a first distal end portion (not labeled) fixedly attached to the rotary portion of the ceiling fan to rotate therewith and a second distal end portion (not seen in the figure) on an underside of which a corresponding one of the blades 68 is securely fitted, a plurality of positioning members 92 each fixedly mounted on an underside of a corresponding one of the blades 68 so as to secure the blade 68 between the second distal end portion of the bracket 90 and the positioning member 92.

Figure 7:
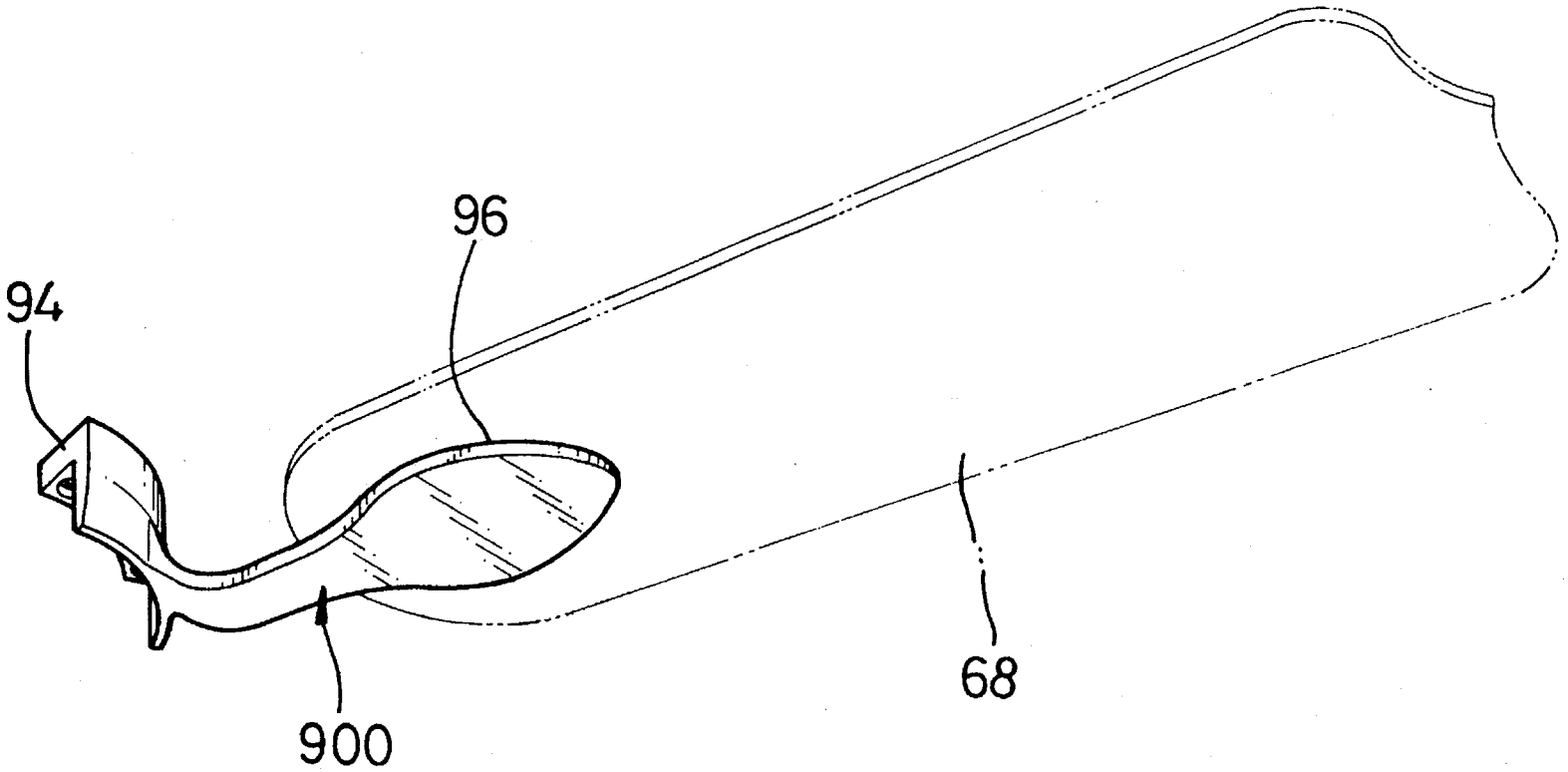
FIG.7 PRIOR ART
FIG. 7 is a perspective view of a second conventional blade mounting device for a ceiling fan in accordance with the prior art.

Referring to FIG. 7, a second conventional blade mounting device in accordance with the prior art is provided for a ceiling fan which comprises a rotary portion (not shown) and a plurality of blades 68, the blade mounting device comprises a plurality of brackets 900 each having a first distal end portion 94 fixedly attached to the rotary portion of the ceiling fan to rotate therewith and a second distal end portion 96 on an upperside of which a corresponding one of the blades 68 is threadedly and securely fitted.

Accordingly, a blade mounting device in accordance with the prior art has the following shortcomings and drawbacks:

(1) The bracket 900 or the positioning member 92 is integrally formed with only a single configuration, so lacking variations in color or modeling. The manufacturer has to develop various molds for producing brackets or positioning members with manifold modeling, color or profile so as to satisfy different requirements of customers, so greatly increasing costs in fabrication.

(2) The bracket 90/900 and the positioning member 92 require enough stiffness and rigidity to bear torsional force and moment exerted by the blades 68 when rotating, therefore, the bracket 90/900 and the positioning member 92 are often made of material with heavy weight, so increasing costs in production and inconvenience for transportation or assembling/dismantling of the ceiling fan. In addition, force required for rotating the ceiling fan is thus increased.

Figure 1:
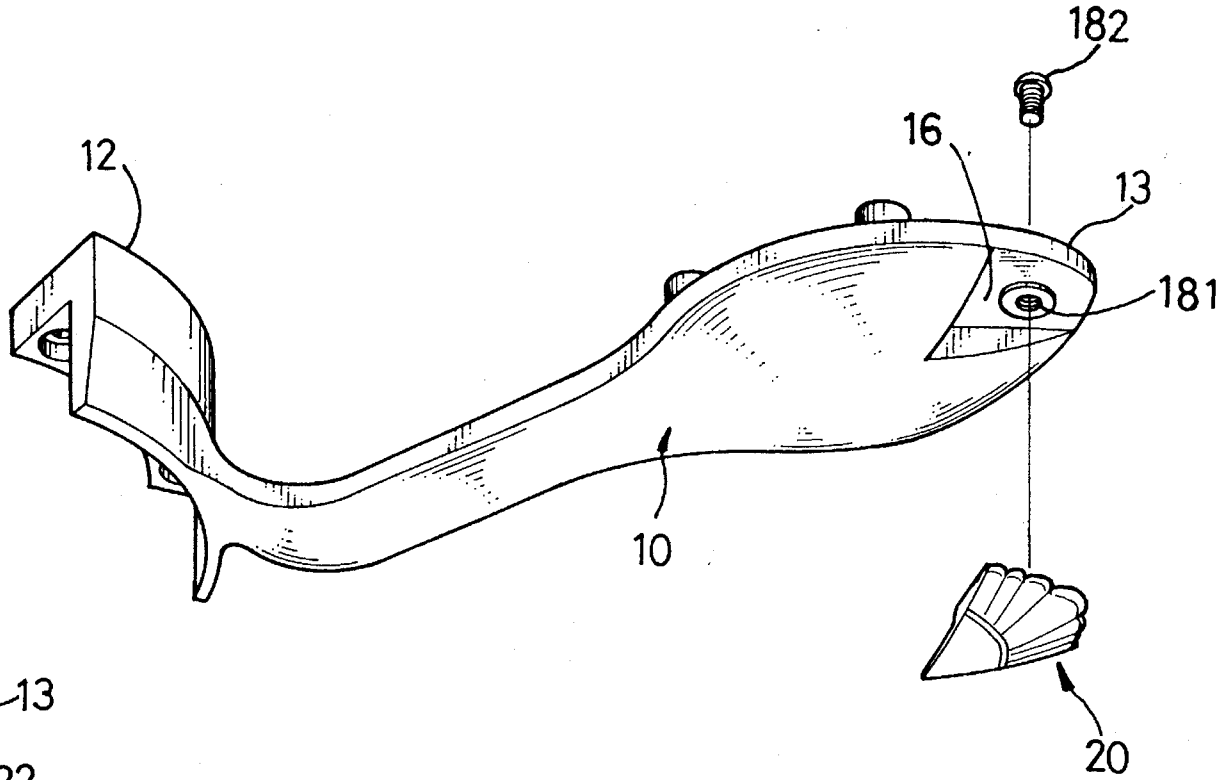
FIG. 1 is an exploded view of a blade mounting device in accordance with a first embodiment of the present invention.
Figure 2:
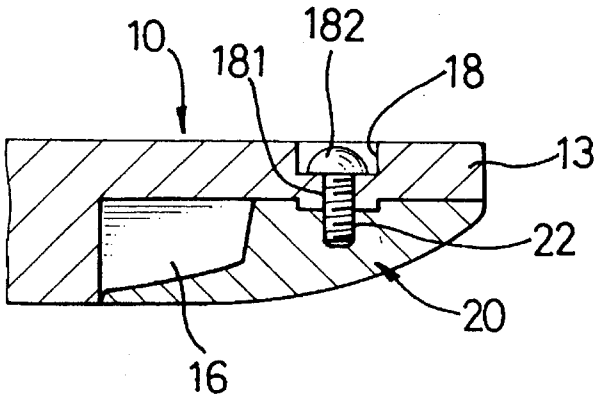
FIG. 2 is a front cross-sectional assembly view of the blade mounting device as shown in FIG. 1.

Referring to FIGS. 1–2, a blade mounting device in accordance with a first embodiment of the present invention is provided for a ceiling fan which comprises a rotary portion (not shown) and a plurality of blades (not shown), the blade mounting device comprises a plurality of brackets 10 each having a first distal end portion 12 fixedly attached to the rotary portion of the ceiling fan to rotate therewith and a second distal end portion 13 on an upperside of which a corresponding one of the blades is threadedly fitted, a recess 16 being defined in an underside of the second distal end portion 13 of each of the brackets 10, a plurality of decorative members 20 each fittingly mounted in and flush with the recess 16 of the second distal end portion 13 of a corresponding one of the brackets 10, each of the decorative members 20 having a different configuration and decorative profile with each other. Referring to FIG. 2, a counterbore 18 and a threaded bore 181 are vertically defined through the second distal end portion 13 of each of the brackets 10 and communicate with the corresponding recess 16, a threaded cavity 22 is vertically defined in an upperside of each of the decorative members 20 and aligns with a corresponding threaded bore 181, a plurality of positioning bolts 182 each extending through a corresponding counterbore 18 and threaded extending through the corresponding threaded bore 181 to be threadedly fitted into a corresponding cavity 22, thereby securely mounting the decorative member 20 on an underside of the second distal end portion 13 of the bracket 10.

Figure 3:
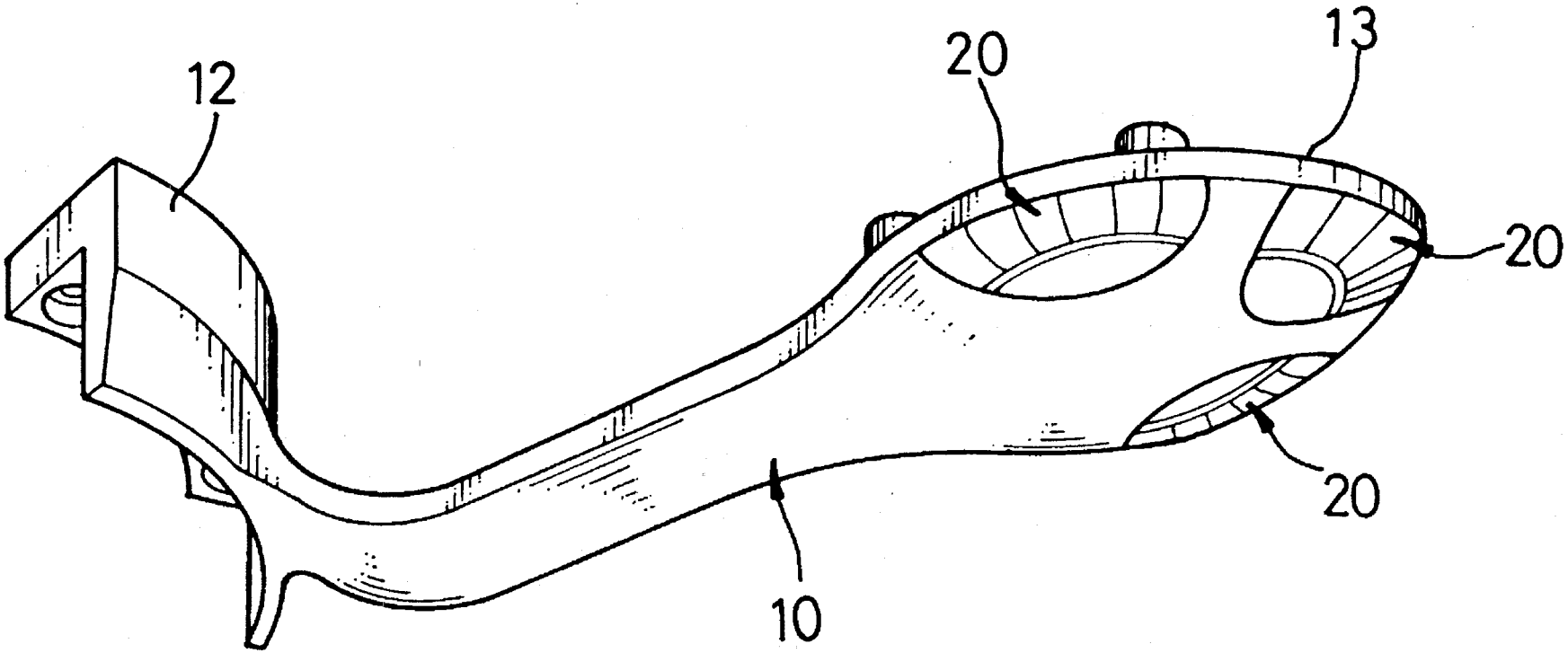
FIG. 3 is a perspective view of a blade mounting device in accordance with a second embodiment of the present invention.

Referring to FIG. 3 with reference to FIG. 2, a blade mounting device in accordance with a second embodiment of the present invention is provided for the ceiling fan wherein a plurality of recesses 16 are defined in an underside of the second distal end portion 13 of each of the brackets 10, a plurality of decorative members 20 each are fittingly mounted in and flush with a corresponding one of the recesses 16. Preferably, each of the decorative members 20 has a different configuration and decorative profile with each other. A plurality of counterbores 18 and threaded bores 181 are vertically defined through the second distal end portion 13 of each of the brackets 10, each of the threaded bores 181 communicates with a corresponding one of the recesses 16, a threaded cavity 22 is vertically defined in an upperside of each of the decorative members 20 and aligns with a corresponding one of the threaded bore 181, a plurality of positioning bolts 182 each extend through a corresponding counterbore 18 and threaded through the corresponding threaded bore 181 to be threadedly fitted into a corresponding cavity 22, thereby securely mounting the decorative members 20 on an underside of the second distal end portion 13 of the bracket 10.

Figure 4:
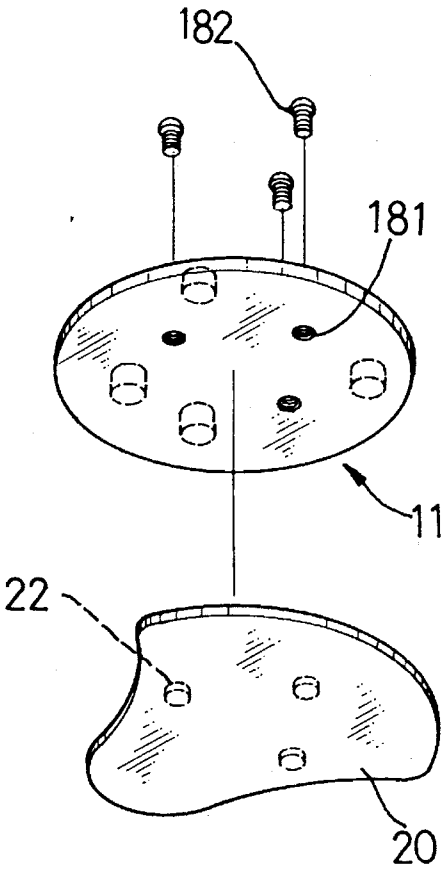
FIG. 4 is a partially exploded view of a blade mounting device in accordance with a third embodiment of the present invention.
Figure 5:
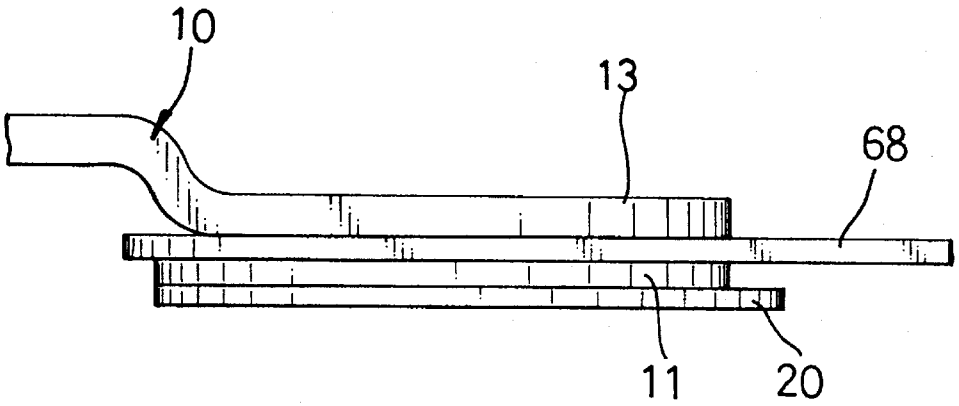
FIG. 5 is a front assembly view of the blade mounting device.

Referring to FIGS. 4–5, a blade mounting device in accordance with a third embodiment of the present invention is provided for a ceiling fan which comprises a rotary portion (not shown) and a plurality of blades 68, the blade mounting device comprising a plurality of brackets 10 each having a first distal end portion (not shown) fixedly attached to the rotary portion of the ceiling fan to rotate therewith and a second distal end portion 13 on an underside of which a corresponding one of the blades 68 is securely fitted, a plurality of positioning members 11 each fixedly mounted on an underside of a corresponding one of the blades 68 so as to secure the blade 68 between the second distal end portion 13 of the bracket 10 and the positioning member 11, a plurality of decorative members 20 each fittingly mounted on an underside of a corresponding one of the positioning members 11, each of the decorative members 20 having a different configuration and decorative profile with each other.

Referring to FIG. 4, a plurality of counterbores (not shown) and threaded bores 181 are vertically defined through each of the positioning members 11, a plurality of threaded cavities 22 are vertically defined in an upperside of each of the decorative members 20, each of the cavities 22 aligns with a corresponding one of the threaded bores 181, a plurality of positioning bolts 182 each extend through a corresponding counterbore 18 and threaded through the corresponding threaded bore 181 of the positioning member 11 to be threadedly fitted into a corresponding cavity 22 of the decorative member 20, thereby securely mounting the decorative member 20 on an underside of the corresponding positioning member 11.

Accordingly, a blade mounting device in accordance with the present invention has the following advantages and benefits:

(1) The blade mounting device provides a plurality of decorative members which have various configurations, profiles, and colors, thereby giving the ceiling fan a lively modeling with manifold color variations so as to satisfy different decorative requirements of customers.

(2) The decorative member is made of a light weight material which is cheap in price, so effectively reducing the weight of the bracket and greatly decreasing costs in manufacturing the bracket, thereby being convenient for transportation and assembling/dismantling of the ceiling fan and helpful for reducing loads required for rotating the ceiling fan.

It should be clear to those skilled in the art that further embodiments of the present invention may be made without departing from the teachings of the present invention.

What is claimed is:

1. A blade mounting device for a ceiling fan which comprises a rotary portion and a plurality of blades, said blade mounting device comprising a plurality of brackets each having a first distal end portion fixedly attached to said rotary portion of said ceiling fan and a second distal end portion onto which a corresponding one of said blades is threadedly fitted, a plurality of recesses being defined in an underside of said second distal end portion of each of said brackets, a plurality of decorative members each fittingly mounted in and flush with a corresponding one of said plurality of recesses of each of said brackets.

2. The blade mounting device in accordance with claim 1, wherein a plurality of counterbores and threaded bores are vertically defined through said second distal end portion of each of said brackets, each of said threaded bores communicates with a corresponding one of said recesses, a threaded cavity is vertically defined in an upperside of each of said decorative members and aligns with a corresponding one of said threaded bores, a plurality of positioning bolts each extend through a corresponding counterbore and threadedly through associated said threaded bore to be threadedly fitted into a corresponding cavity, thereby securely mounting said decorative member on an underside of said second distal end portion of said bracket.

3. A blade mounting device for a ceiling fan which comprises a rotary portion and a plurality of blades, said blade mounting device comprising a plurality of brackets each having a first distal end potion fixedly attached to said rotary potion of said ceiling fan and a second distal end portion on an underside of which a corresponding one of said blades is securely fitted, a plurality of positioning members each fixedly mounted on an underside of a corresponding one of said blades so as to secure each of said blades between said second distal end portion of an associated bracket and an associated positioning member, a plurality of decorative members each fittingly mounted on an underside of a corresponding one of said plurality of positioning members.

4. The blade mounting device in accordance with claim 3, wherein a plurality of counterbores and threaded bores are vertically defined through each of said positioning members, a plurality of threaded cavities are vertically defined in an upperside of each of said decorative members, each of said cavities aligns with a corresponding one of said threaded bores, a plurality of positioning bolts each extend through a corresponding counterbore and threadedly through associated said threaded bore of said positioning member to be threadedly fitted into a corresponding cavity of said decorative member, thereby securely mounting said decorative member on an underside of said corresponding positioning member.

* * * * *